United States Patent [19]

Simpson

[11] Patent Number: 4,568,108

[45] Date of Patent: Feb. 4, 1986

[54] CONTINUOUS FORMS LEADER

[75] Inventor: Peyton G. Simpson, Dallas, Tex.

[73] Assignee: Pollution Control Products Co., Dallas, Tex.

[21] Appl. No.: 621,670

[22] Filed: Jun. 18, 1984

[51] Int. Cl.[4] ..... B42D 15/00

[52] U.S. Cl. ..... 281/5; 281/2; 282/12 R

[58] Field of Search ..... 156/289; 281/2, 5, 1 R, 281/42, 45; 282/1, 2, 3, 1 A, 11.5 R, 11.5 A, 12 R

[56] References Cited

U.S. PATENT DOCUMENTS

| | | | |
|---|---|---|---|
| 2,438,063 | 3/1948 | Lorenz-Risler . | |
| 2,579,581 | 12/1951 | Hustad . | |
| 2,812,937 | 11/1957 | Robinson . | |
| 3,462,054 | 8/1969 | Foor . | |
| 3,788,536 | 1/1974 | Brown . | |
| 4,070,223 | 1/1978 | Stalzer | 156/289 X |
| 4,448,588 | 5/1984 | Weingarten | 282/11.5 A X |
| 4,487,645 | 12/1984 | Weston | 156/289 X |

FOREIGN PATENT DOCUMENTS

| | | | |
|---|---|---|---|
| 452479 | 3/1968 | Switzerland | 282/5 |

OTHER PUBLICATIONS

*IBM Technical Disclosure Bulletin*", Carton-To-Carton Continuous Forms Card Splicing", Haughton, W. F. & Ward, R. F., vol. 13, No. 1, Jun. 1970, p. 90.

*Primary Examiner*—Paul A. Bell
*Attorney, Agent, or Firm*—Harold E. Meier

[57] ABSTRACT

This invention relates to a leader for use in processing lengthy strips of continuous business forms assemblies. The leader includes feeding means complemental to that of the forms assemblies and one or more transverse areas of pressure-sensitive adhesive for temporary positive attachment, one edge portion being applicable to detachment and application over the leading edge of the endmost portion of the form assembly and the other to a major body portion of the assembly. The leader may also have several other embodiments such as a folded portion for attachment to the forms leader edge. The leader is especially applicable to initiating data processing operations of forms assemblies on printers of various feeding types.

9 Claims, 8 Drawing Figures

FIG. 1
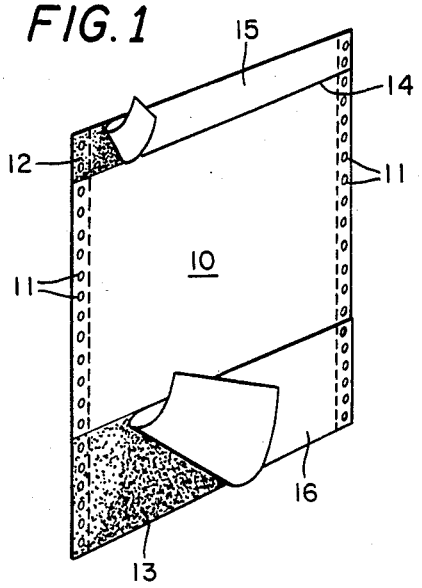
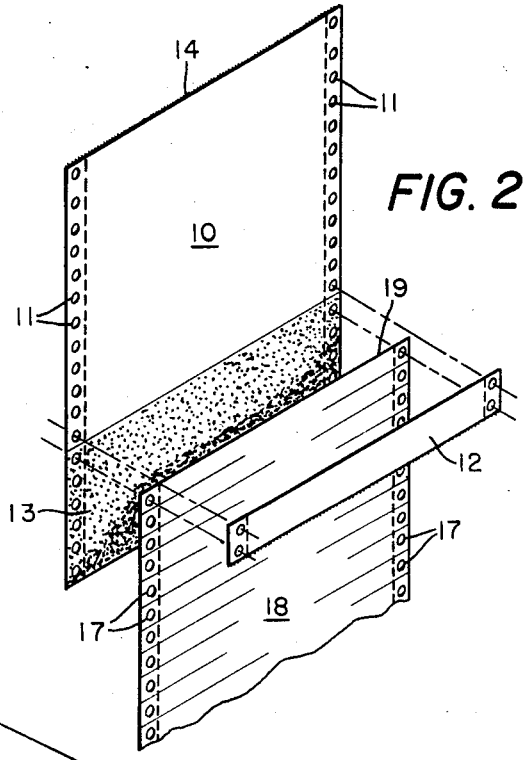
FIG. 2
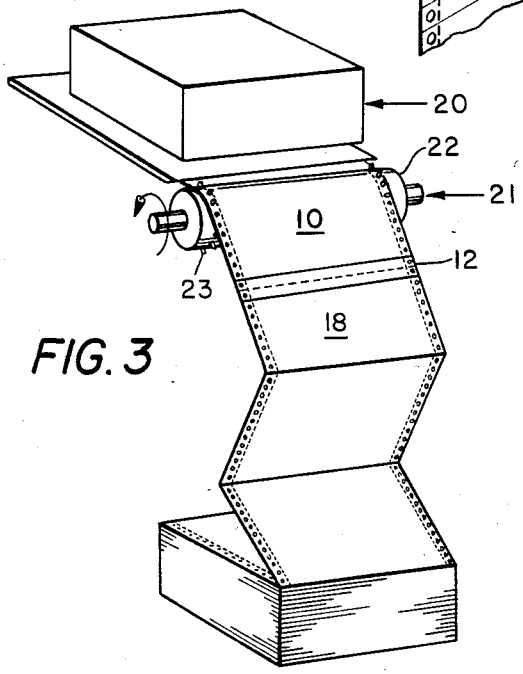
FIG. 3

CONTINUOUS FORMS LEADER

BACKGROUND OF THE INVENTION

This invention relates to a leader for use in the processing of continuous business forms.

At present, business forms of many varied types which are manufactured in long continuous strips are being processed in computerized operations wherein much more rapid and accurate processing of such forms is achieved by modern day computers. Most commonly, such processing includes the printing of information on individual form lengths of a continuous business forms assembly such as by a high-speed printer which is normally operated by a computer. In initiating such operations, the endmost form length of a continuous assembly of business forms is normally manually introduced into the printer and manipulated until such time as the printing keys of the printer are oriented properly with respect to the particular areas of the form length on which the information is to be inscribed. Once the proper orientation has been attained, the processing operation is initiated and requires little or no manual attention until the operation is terminated. As is well known, the inscribed information can be applied to successive forms with extreme speed and accuracy by such data processing equipment.

One inherent difficulty in initiating such inscribing process occurs when the endmost form of the continuous forms strip or assembly is rendered useless by the manual aligning process. Frequently during attainment of proper alignment the printer may be manually advanced to determine whether precise alignment has been achieved. Obviously where proper alignment is not achieved, the inscribed information is improperly aligned on the form rendering the same nonusable.

In many types of data processing operations, the loss of the endmost form is no problem as the individual first form length may simply be discarded if found to be unusable. However, in certain types of data processing, it is very undesirable to discard the endmost unusable form length without causing additional bookkeeping effort such as where the form lengths are consecutively numbered or serially indexed.

As is well known in the trade, many stock and bond transfers are processed by computers and certificates indicating ownership are issued after being imprinted by a printer operated by a computer. As is common practice, such certificates are manufactured in continuous form with each certificate constituting an individual form length of a continuous business forms assembly with each individual form length being prenumbered or serialized. If an individual form length must be discarded, additional bookkeeping is required to indicate that a certificate bearing a prescribed number has been voided and not used. In such situations, normal methods of manually aligning the endmost individual form of a continuous forms assembly in a printer are unsatisfactory due to such increased bookkeeping operations.

In addition, many modern day computer printers now have feeding mechanisms for the continuous forms assemblies at the exit from the printer rather than at the entrance. In such case the forms are pulled rather than pushed through the printer and require that a continuous forms leader be applicable to both types of printers whether the feeding mechanisms be located at either the entrance or exit areas. The forms leader must positively retain the endmost form and frictional engagement alone will normally not suffice where the forms assembly must be pulled through the printer.

SUMMARY OF THE INVENTION

This invention relates to an improved leader for use with continuous business forms assemblies to permit rapid alignment with such forms assemblies and data processing apparatus of various types in such manner that no individual form length of the forms assembly is rendered defective or unusable.

The continuous forms leader of this invention permits temporary bonding of the leader to the continuous forms assembly to facilitate the loading of the printer whether its feeding mechanism is based on a pushing or pulling principle. The leader possessing adhesive bonding characteristics or temporary retention means other than friction permits the leader to work equally well in either feeding arrangement. The leader preferably possesses several separate areas of adhesive attachment including a detachable or folded-over upper portion to be applied over the upper edge portion of the forms in such manner that they do not catch or snag on any projections on the inlet area of virtually all types of printers.

At least one peripheral edge of the leader is provided with feeding means complementary to the feeding means of the continuous forms assembly as well as that of the forms processing machinery or printer. Normally this consists of at least one uniformly spaced-apart series of pinholes or open apertures along one lengthwise edge which are engaged by driving pins of the printer. The width of the leader is generally the same as the width of the continuous forms assembly with which it is to be used, normally of the order of about 8½ inches. A pressure-sensitive adhesive is applied to the uppermost edge portion of the leader with directions as to how the adhesively treated area is detached or folded and applied over the leading edge of the forms to be processed following alignment of matching feeding pinholes.

The preferred form of the leader possesses one or more band-like areas of pressure-sensitive adhesive extending normal to the lengthwise dimension of the forms assembly. The lower area is pressed against the backside of the continuous forms assembly after the complementary feeding means are aligned. The leader in one version possesses a detachable portion at its upper edge coated with pressure-sensitive adhesive. The adhesively-treated areas may be protected by separate peelable strips of removable flexible material of comparable width and length to protect the adhesive until usage of the leader is desired. Alternately, the adhesively-treated areas may be protected by another leader in a pad of multiple leaders from which the leader to be used is removed.

Further details of the present invention and its construction and use will be apparent from the following specification taken in conjunction with the accompanying drawings.

DESCRIPTION OF THE DRAWINGS

FIG. 1 is a perspective view of one embodiment of the forms leader having upper and lower adhesive areas.

FIG. 2 is an exploded perspective view of combining the leader of FIG. 1 and endmost portion of a forms assembly.

FIG. 3 is a perspective view of a continuous business forms assembly made ready for initial processing through a printer by the use of the leader of FIG. 1.

DESCRIPTION OF THE PREFERRED EMBODIMENT

Figure 4:
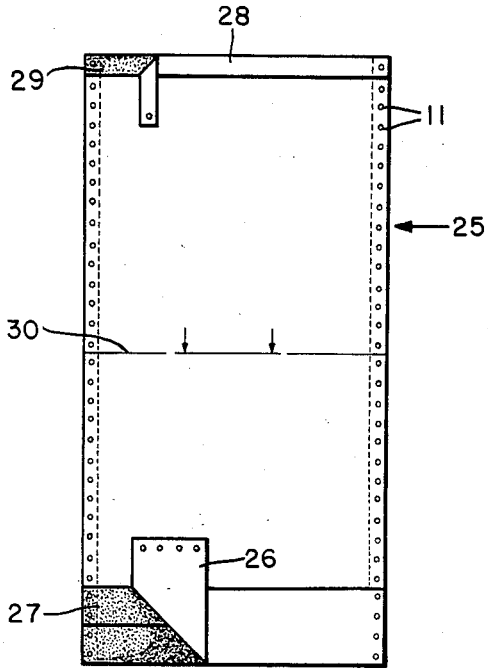
FIG. 4 is a plan view of a second embodiment of the forms leader having a central fold line.

A preferred embodiment of a leader made in accordance with the present invention as shown in FIG. 1. The leader for use in processing continuous forms assemblies consists of a flat sheet of flexible material designated by the numeral 10. The leader is preferably rectangular in shape having a single thickness and may be comprised of paper or plastic. A series of equi-spaced pinholes or aperture openings 11 are formed along at least one margin to provide a feeding means. Such pinholes are widely used in the trade on continuous forms assemblies to cooperate with driving pins of the feeding mechanism of form processing machinery including printers. The marginal alignment of pinholes may exist along one or both lengthwise marginal edges of the continuous forms to provide uniform retention and controlled movement of the continuous forms through the processing equipment. FIG. 1 illustrates the leader having the plurality of feeding pinholes 11 spaced on equal centers along both margins of the leader matching the forms assembly. Thus, the spacing between the leader apertures corresponds to the spacing between similar holes in the margins of the continuous forms assembly. Such assembly with which the leader is used matches the spacing of feed pins in the feeding mechanism of the data processing apparatus. This is true whether the feeding mechanism is located at the inlet or outlet side of the inscribing apparatus.

The upper edge portion of the leader designated by the numeral 12 preferably has a coating of pressure-sensitive adhesive extending throughout its width normal to the feeding means along one or more adjacent edges. A pressure-sensitive adhesive such as those manufactured by 3M company and commonly used on its "Post-It" note pads, Product Numbers 653, 654 and 655, is preferably applied to the upper edge portion of the form. A spaced-apart intermediate or lower portion of the leader designated by the numeral 13 is also coated with a wide band of similar pressure-sensitive adhesive extending preferably throughout its full width for adherence to a body portion of the continuous forms assembly. The lower adhesive area is preferably much wider than the edge portion adhesive area to facilitate positive aligned attachment to the backside of the leading portion of the forms assembly. The leader 10 also possesses a serrated separation line 14 along or adjacent to the interior extremity of the adhesive 12 applied to the upper edge portion to facilitate detaching the upper edge portion. The upper portion is used to cover the front of the leading edge portion of the continuous forms assembly.

The leader may have complemental strips 15 and 16 of flexible peelable material adhered over the adhesive areas 12 and 13 respectively, which are spaced-apart a distance equal to the length of the endmost individual form of the continuous forms assembly. Normally the strips or sheets of peelable material are fully coextensive with the adhesive areas. Printed instructions or indicia are applied to the leader or the peelable strips describing preferred use of the leader.

The leading end portion of continuous forms assembly is normally placed over the lower adhesive area of the leader after the adhesive area is exposed by removing the peelable strip 16, partially on and partially off the leader as shown in FIG. 2. The complemental pinholes or feeding means 17 of the forms assembly 18 and leader 10 are aligned along matching edges or both edges where such feeding means exist. With the pinholes in proper alignment, the upper edge portion of the leader is detached along the line 14, positioned and pressed downwardly over the upper edge of the forms assembly 18 in face-to-face relation. The adhesive area of the detached portion 12 is positioned to contact the front of the assembly upper edge 19 and the leader. The lower adhesive area 13 of the leader is adhered to the backside of the forms assembly. With the upper edge portion the leader adhered over the leading edge 19 of the continuous forms assembly, the leader is thus able to carry the forms assembly through a printer whether its feeding mechanism be located on either the entrance or exit side of the printer.

Following attachment of the leader to the forms assembly, the exposed face of the leader has a length comparable to the first form length of the assembly to align the information to be inscribed on such first form.

It is preferred that the edge portion of adhesive on the leader have sufficient width to encompass and bondingly retain the full edge portion of the forms assembly, especially where multiple-thickness forms are processed. The detached upper adhesive area of the leader properly positioned and adhered prevents the continuous forms assembly from catching on any interior projection during its passage through the printer. The smooth-faced single edge is provided to move through the inlet path of the printer without difficulty and is much less likely to allow the forms assembly and leader to hang up or be snagged by any impediment in the inlet path.

As shown in FIG. 3 data processing apparatus and more specifically a high-speed printer designated by the numeral 20 is employed to receive the combined leader and forms assembly. As a part of the printer, a feeding mechanism designated by the numeral 21 normally includes at least one driven roller 22 having a series of radially extending pins 23 thereon. Usually the printer includes a pair of rollers in close proximity to each other, both rollers having such projecting pins which are received in the apertures in the leader as well as those in the adhered forms assembly.

When the rollers are driven in the direction of the arrow, the leader and continuous forms assembly are driven into and through the printer. As stated, the width of the leader is substantially equal to the width of the forms assembly to carry the same without damage or distortion into and through the printer in a manner whereby it can be fully inscribed on its exposed front surface. With the lower adhesive portion of the leader adhered to the backside of the first endmost form, the leader acts as the first of such forms available for inscribing desired information by the printer.

In another embodiment of the present invention as shown in FIG. 4, the leader has the length of two individual forms on its exposed face. The lower portion of the leader 25 has a covering 26 over its lower adhesive area 27 which is removed to expose the adhesive. The endmost edge of the continuous forms assembly is placed along a designated marking in an intermediate region of the adhesive area, leaving some of the adhesive exposed. The assembly is placed over the lower portion of the leader with the pinholes of the several members properly aligned. The covering 28 over the upper adhesive area 29 of the leader is removed exposing the adhesive. The leader having a fold line 30 at a designated midpoint region is folded thereat into face-to-face relation. The upper portion has sufficient length to cover the edge portion 19 of the forms assembly and to contact the exposed adhesive area of the leader lower region. When the leader is folded, its edgewise pinholes are properly aligned. The leader then has a double thickness with the forms edge retained at a lower region. The fold line is positioned to permit ready alignment of the edgewise feeding means of the folded-over leader as well as with the forms assembly.

Figure 5:
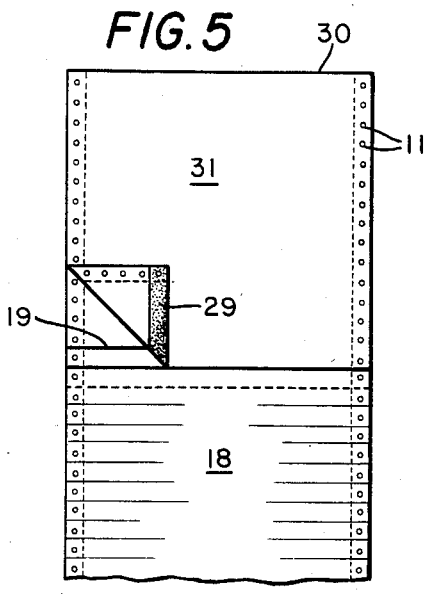
FIG. 5 is a similar view of the FIG. 4 embodiment folded over and adhesively attached to the forms assembly.

The combined leader and assembly as shown in FIG. 5 are then ready to be fed into the printer the exposed portion 31 of the leader having a length equivalent to the first form of the assembly.

Figure 6:
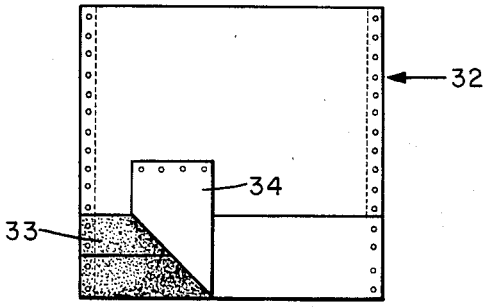
FIG. 6 is a plan view of a third embodiment of the forms leader having only the lower adhesive area.
Figure 7:
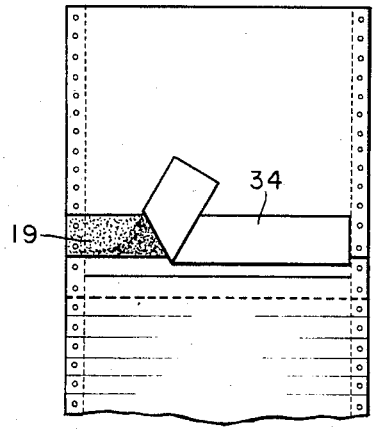
FIG. 7 is a similar view of the FIG. 6 embodiment adhesively attached to the forms assembly.

In another embodiment of the present invention as shown in FIG. 6, the leader 32 has a pressure-sensitive lower adhesive area 33 which is covered with a peelable strip 34 which is removed to expose the adhesive. The leader has a length equal to the first individual form of the forms assembly. The endmost edge portion 19 of the assembly is placed on the adhesive area 33 along a designated line, and the removed peelable strip 34 having adhesive thereon is applied over the edge, both on and off the assembly and contacting the leader adhesive. The forms assembly is then ready to be inserted into the printer mechanism. The leader and forms are smoothly joined with the edgewise pinholes in proper alignment for initiation of the printing operation.

Figure 8:
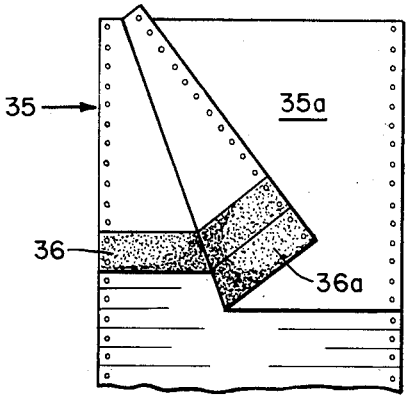
FIG. 8 is a plan view of a fourth embodiment of the present invention wherein two forms leaders are attached over the forms assembly.

In still another version of the present invention the leader shown in FIG. 8, the leader 35 having an adhesive band 36 only on its lower portion can be taken for retaining the forms assembly at a designated lower line marked receiving for its edge. Another separate leader **35*a* having the same structure is taken and applied face down with its adhesive area 36*a*** contacting both the forms assembly edge portion and the exposed adhesive of the first leader. Thus, the pair of leaders serve to adhesively retain the forms assembly.

Following discharge from the printer, the selected leader may be removed from the forms assembly and discarded, or reused as desired. The leaders may be made in either individualized form in pads, or disposable strip form in varied sizes to fit the forms assemblies, or in reusable form as desired.

Various modifications may be resorted to within the spirit and the scope of the appended claims.

I claim:

1. A form leader for use with continuous business forms having feeding means along at least one lengthwise margin of said forms for cooperating with feeding means on business forms processing machinery, said form leader comprising a flat sheet of flexible material having feeding means extending along at least one margin of said sheet complemental to the said feeding means of said forms, and at least one surface portion of said leader having pressure-sensitive adhesive material thereon adapted to be adhered to one side of the endmost portion of said forms following alignment of the complementary feeding means of said leader and forms to facilitate aligned entry of said forms into said business forms processing machinery, an index line on said leader to position the endmost portion on the adhesive material such that the exposed length of the leader is complementary to the length of the first individual form, and means for covering the endmost portion of the form and any exposed adhesive material.

2. A form leader in accordance with claim 1, wherein said leader has two spaced-apart transverse areas which are adhesively treated for adhesive attachment to the endmost portion of said forms.

3. A form leader in accordance with claim 1 wherein an upper end portion of said leader includes said means for covering and is adhesively-treated and adapted for detachment from said leader and adherance over the endmost portion of said forms in contact with both said endmost portion and the adhesive material of said leader.

4. A form leader in accordance with claim 1, wherein an upper end portion of said leader includes a pressure-sensitive adhesive material and is adapted for adherance over the endmost portion of said forms by folding said leader at an intermediate central area in face-to-face relation.

5. A form leader in accordance with claim 4, wherein said leader has a lengthwise dimension greater than twice the lengthwise dimension of the individual forms of said continuous business forms with a fold line adjacent the mid-point of said leader, said fold line permitting alignment of said feeding means along the margin of said leader when in folded relation with said upper end portion overlapping and contacting the endmost portion of said forms.

6. A form leader in accordance with claim 1, including two pressure-sensitive adhesive material surface portions which are spaced-apart vertically at upper and lower regions of the facing surface of said leader.

7. A form leader in accordance with claim 1 wherein the upper end portion of said leader has a relatively narrow coating of adhesive material and the lower major portion of said leader has a relatively wide coating of adhesive material.

8. A form leader for use with continuous business forms having feeding means along at least one lengthwise margin of said forms for cooperating with feeding means on business form processing machinery, said form leader comprising a flat sheet of flexible material having feeding means extending along opposite edges of said sheet complemental to the said feeding means along the lengthwise edges of said forms, said leader having a length complemental to the first individual form of said continuous forms, an upper end portion of said leader and a lower main body portion of said leader having pressure-sensitive adhesive material thereon in relatively narrow and wide transverse band-like coatings respectively, said adhesive coating of the lower main body adapted to retain the endmost edge portion of the first individual form following alignment of the complementary feeding means of said leader and forms to facilitate aligned entry of said forms into said business forms processing machinery, an index line on said leader to facilitate positioning the endmost edge portion such that the exposed length of the leader is complementary to the length of the first individual form, said adhesive coating of the upper end portion adapted to retain the endmost end portion between the main body portion and the upper end portion.

9. A form leader in accordance with claim 8, wherein the adhesive material of the upper end portion is detachable for adherance over the endmost edge portion of said forms.

* * * * *